United States Patent [19]

Koller

[11] 4,314,604

[45] Feb. 9, 1982

[54] APPARATUS FOR THE SEGREGATION OF WORN-OUT CLEANING BODIES

[76] Inventor: Josef Koller, Ziegeleiweg 26, 4006 Erkrath 2, Fed. Rep. of Germany

[21] Appl. No.: 77,229

[22] Filed: Sep. 20, 1979

[30] Foreign Application Priority Data

Sep. 23, 1978 [DE] Fed. Rep. of Germany ... 7828382[U]
Sep. 23, 1978 [DE] Fed. Rep. of Germany ... 7828404[U]

[51] Int. Cl.[3] ..... F28G 1/00
[52] U.S. Cl. ..... 165/95; 15/3.51
[58] Field of Search ..... 209/551, 674; 165/95; 15/3.51; 100/121

[56] References Cited

U.S. PATENT DOCUMENTS

| | | | |
|---|---|---|---|
| 2,850,161 | 9/1958 | Reilly | 209/674 |
| 2,905,318 | 9/1959 | Schell | 209/551 X |
| 3,143,213 | 8/1964 | Barton | 209/674 |
| 3,505,701 | 4/1970 | Keil | 100/121 X |
| 3,841,397 | 10/1974 | Eimer | 165/95 |
| 3,872,920 | 3/1975 | Honma et al. | 165/95 |
| 4,003,831 | 1/1977 | Tishkov et al. | 209/674 X |
| 4,135,574 | 1/1979 | Treplin et al. | 165/95 |

*Primary Examiner*—Robert J. Spar
*Assistant Examiner*—Edward M. Wacyra
*Attorney, Agent, or Firm*—Sprung, Felfe, Horn, Lynch & Kramer

[57] ABSTRACT

The invention relates to an apparatus for the segregation of worn-out cleaning bodies consisting of resiliently deformable material such as rubber or plastic from the coolant circuit of a heat exchanger for the purpose of segregating and removing those cleaning bodies which on account of wear no longer have sufficient dimensions to clean the tubes of the heat exchanger. Cleaning bodies found still good are—together, if desired, with the new cleaning bodies replacing the rejected cleaning bodies—delivered back through the injecting device to the coolant circuit such that any air which has penetrated during the sorting or is contained in new cleaning bodies is virtually completely removed from the sponge-like cleaning bodies, and the cleaning bodies are imbibed with coolant fluid in order to assure a uniform distribution of the cleaning bodies in the coolant fluid and to prevent any floating up or sinking of the cleaning bodies and hence to prevent improper cleaning of the heat exchanger tubes. The novel apparatus permits the elimination and the replacement, as desired, of no longer effective cleaning bodies without interruption of the cooling circuit.

12 Claims, 9 Drawing Figures

APPARATUS FOR THE SEGREGATION OF WORN-OUT CLEANING BODIES

BACKGROUND

The invention relates to an apparatus for the segregation of worn-out cleaning bodies made of resiliently deformable material such as rubber or plastic which are carried in the cooling fluid circuit of a heat exchanger.

The cleaning bodies, usually foam rubber balls, are carried in the cooling fluid circuit, usually the cooling water circuit, and serve for the cleaning of the heat exchanger. To achieve a cleansing action, the cleaning bodies must be larger than the pipe being cleaned. Since the cleaning bodies become worn, the worn-out ones must be regularly separated from the others and replaced with new ones.

An apparatus is known from German Pat. No. 2,254,677 which removes the worn cleaning bodies within the cooling water circuit. The sorting is performed automatically, while in other apparatus of this kind (see for example the publication, "Brennstoff, Warme, Kraft," Vol. 10, No. 3, p. 123, which is cited in this patent as the state of the art), the removal of the worn-out cleaning bodies is still performed manually by means of a perforated sieve, which is a very tedious operation.

However, the automatically operating system known through the above-named patent still has disadvantages. One particularly great disadvantage is that always only some of the worn cleaning bodies are removed from the cool liquid, while some are not. Also, no measure are provided for replacing the removed worn cleaning bodies with new cleaning bodies, so that in the course of time the cooling fluid becomes short of cleaning bodies. The system must therefore be examined at regular intervals to determine whether it contains enough cleaning bodies and, if need be, to put new cleaning bodies into the coolant circuit. Continuous operation over longer periods of time, therefore, appears to be impossible.

It is the object of the invention to improve an apparatus of the kind mentioned above such that all of the cleaning bodies present in the coolant circuit can be examined for degree of wear and rejected cleaning bodies can be constantly replaced with new ones as needed.

SUMMARY

This problem is solved by the fact that, in accordance with the specific part of the principal claim, a cleaning body diverter inserted into the circuit is provided, which is connected by a branch conduit to a device for sorting cleaning bodies on the basis of specific diameter limits and a cleaning body injecting device also inserted in the circuit and connected to an output from the sorting device.

In this manner it is possible to keep the coolant fluid circuit free of any cleaning bodies which no longer exercise their cleansing action on account of excessive wear. Since such unserviceable cleaning bodies do not remain in the circuit, the flow conditions improve and thus also the heat exchanging action of the system. On the other hand, it becomes possible to replace every separated cleaning body with a corresponding new cleaning body, so that always a constant, effective number of cleaning bodies is continuously carried by the cooling fluid. In this manner uninterrupted operation is possible, without interruptions for the purpose, for example, of putting in new cleaning bodies.

The apparatus in accordance with the invention will be especially advantageous if the sorting device consists of a feeding container accommodating the cleaning bodies, and of a sorting means disposed underneath it which has a downwardly tapering trough shape, (e.g., V-shaped, trapezoidal or semicircular), is made by means of a vibrator to serve as a linear conveyor, and has at the end two measuring rails spaced apart from one another, which are parallel to one another, parallel in a stepped form, or divergent from one another. This type of device is especially simple to construct and simultaneously permits visual control of the sorting action. Another advantage lies in the fact that this sorting device can also be used for the feeding in of cleaning bodies which are basically new, but which on account of the method by which they are manufactured, for example, either do not have uniform spherical diameters or are not even spherical but cigar-shaped for example. To prevent the linear conveyor of the sorting device from becoming jammed by an excessive feed of cleaning bodies, the bottom of the container consists, in an advantageous further development of the invention, of one or more flaps articulated to the bottom edge of the container, which can be swung downwardly from the horizontal by drive means. If this swinging takes place, cleaning balls are released downwardly into the linear conveyor trough in such quantity that the trough is just filled. Upon the subsequent closing of the flaps, the supply in the conveyor is relieved to the extent that jamming can no longer occur.

The operation of these flaps can be effected advantageously by means of an eccentric, it being desirable to provide between this drive means and the flap a resilient connecting means, especially a coil spring, which permits a length accommodation and protects cleaning bodies caught between the flaps against excessive stress from the closing action.

By means of counting devices, which especially can be operated by means of a photoelectric cell, it is possible to determine how many worn-out cleaning bodies have been removed and how many still good cleaning bodies remain.

By means of pulses supplied by such a photoelectric cell, the feeding of new cleaning bodies into the injection device could then also be controlled, so that, for example, for each cleaning body removed, a new cleaning body will be delivered into the feeding container of the sorting device or, if a specific diameter for this new cleaning body is assured, into the injection device.

This injection devices does not provide merely for the correct feeding of the cleaning bodies back into the coolant stream. In order to achieve an equal cleaning action in all tubes of the heat exchanger, the cleaning bodies must be distributed in the fluid in a uniformly random manner. This will be the case only if the specific gravity of the cleaning bodies is approximately equal to that of the fluid. Since the cleaning bodies would naturally float due to the air entering them during the sorting operation, they must be approximately free of air when they are returned into the fluid.

This has been accomplished heretofore by repeated manual squeezing out of the cleaning bodies in the fluid until all the air had escaped and the pores had become completely full of the cleaning fluid. This manual method, of course, cannot be used for the automatic operation that is here being striven for. Other known devices whereby sponge rubber balls are placed in a container and the container is then evacuated of air, the air escaping from the foam rubber balls due to the vacuum in the container, see German Pat. No. 2,408,973, German Offenlegungsschrift No. 2,449,844 and German Offenlegungsschrift No. 2,451,909, are on the one hand too complicated, or on the other hand they permit not continuous operation but only batch operation.

For continuous operation, the device for the injection of cleaning bodies into the fluid circuit is, in another advantageous further development of the invention, improved by an arrangement whereby the pressing of included air from the porous, resilient cleaning bodies is performed in a continuous manner. This is achieved by making the injection device to consist of a container receiving the cleaning bodies and a pressing means comprising one or more pairs of rollers disposed beneath it. An especially great pressing action is achieved if the rollers of each pair are rotated in opposite directions.

This injection device can be disposed, for example, in the area of a lock in the coolant circuit, as for example on a lock margin that becomes free upon the removal of the lock cover. Such a lock furthermore permits not only the insertion of cleaning bodies but also the removal of these bodies for the purpose of then feeding them to the sorting device mentioned in the beginning. Instead of this kind of removal of cleaning bodies from the coolant circuit, however, the removal can be accomplished also by means of already-known shunting devices; in this connection, see the applicant's German patent application No. P 2,923,903.0 as well as other disclosures cited in the latter application, e.g., German Auslegeschrift No. 1,227,040, German Pat. No. 2,612,905, and German Auslegeschrift No. 2,612,917.

BRIEF DESCRIPTION OF THE DRAWINGS

The invention will be further explained as follows with the aid of embodiments which are represented in the drawings, wherein.

DESCRIPTION OF THE PREFERRED EMBODIMENTS

Figure 1:
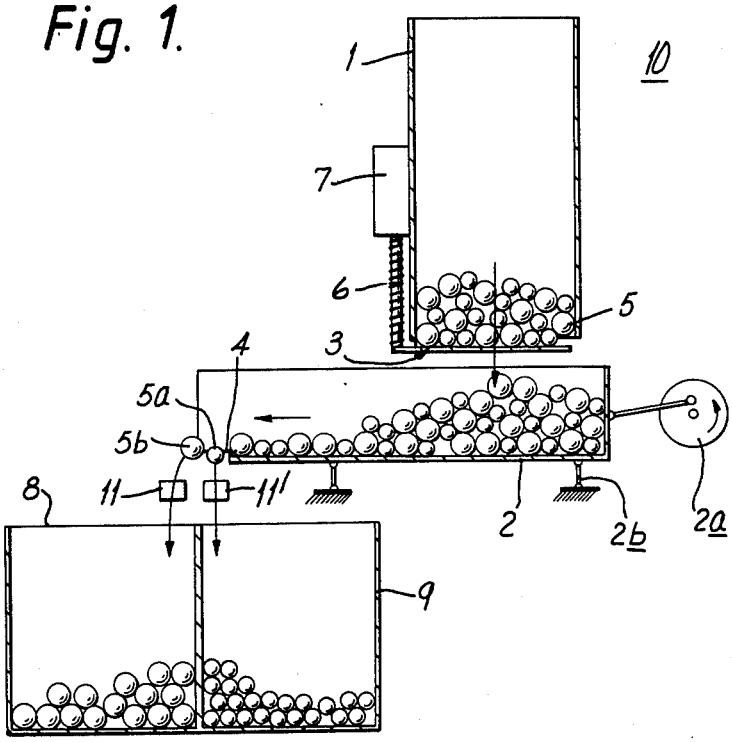
FIG. 1 is a schematic sectional view through the sorting device of the apparatus of the invention for the segregation of worn-out cleaning bodies.
Figure 2:
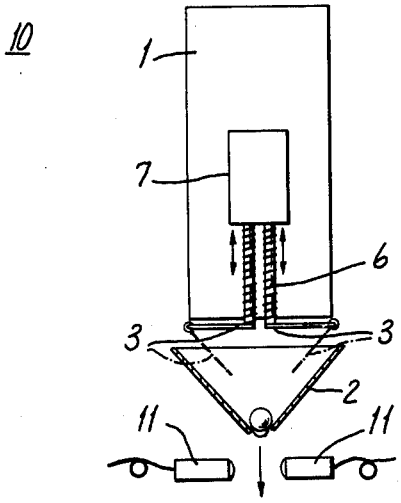
FIG. 2 is a side view of the sorting device of FIG. 1, the latter being constructed in the shape of a V.
Figure 3:
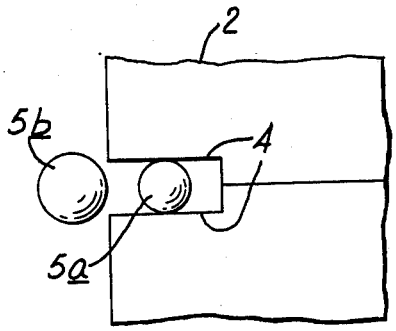
FIG. 3 is a plan view of a parallel measuring rail arrangement at the end of the sorting device.
Figure 4:
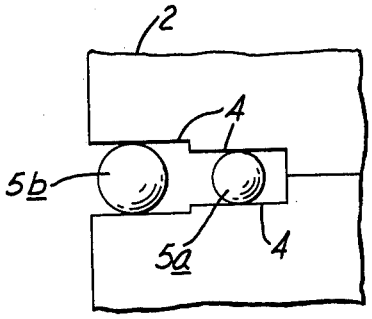
FIG. 4 is a plan view similar to FIG. 3 of a measuring rail arrangement, but with stepped parallel measuring rail sections.
Figure 5:
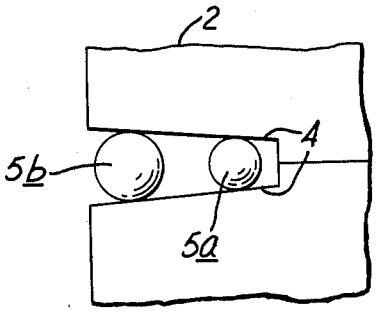
FIG. 5 is a plan view similar to FIG. 3, but of measuring rails disposed divergently from one another.

FIG. 1 shows in a schematic sectional view the sorting device 10 of the apparatus of the invention for the segregation of worn-out cleaning bodies. The sorting device 10 consists of a feeding container 1 accommodating the cleaning bodies and a linear conveyor 2 represented here in a V-shape, which is brought into oscillating movement by means, for example, of an excentric 2*a* driven by a motor which is not represented. The linear conveyor 2 can be mounted on rubber buffers or other supporting means 2*b* permitting a linear movement. Instead of the V-shape, as it can be seen especially in FIG. 2, other forms are also conceivable, which produce a downwardly converging form, e.g., a trapezoidal form or semicircular form. At the outlet end of the sorting device 2 there are disposed two measuring rails 4 which are represented in greater detail in FIGS. 3 to 5. The distance between the measuring rails, i.e., the gap formed by the measuring rails, is adjusted to the size of the cleaning bodies 5 to be sorted. As seen in FIGS. 3 to 5, the measuring rails 4 can be of different shape. The form represented in FIG. 3 results in the selection of those cleaning bodies which are conveyed by the vibration forces past the measuring rails 4, while the cleaning bodies 5*a* having a diameter equal to or smaller than the gap width drop through the gap into a receiver 9, the cleaning bodies also roll past a photoelectric cell 11' which then gives a pulse which can be processed in a manner yet to be described.

Figure 6:
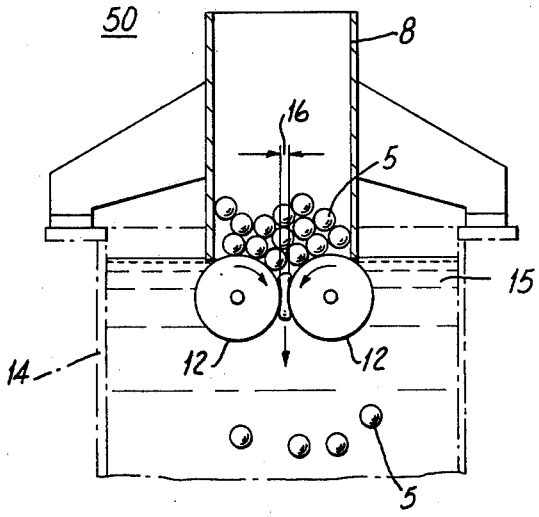
FIG. 6 is a schematic sectional view through the cleaning body injecting device with a pair of rollers.
Figure 7:
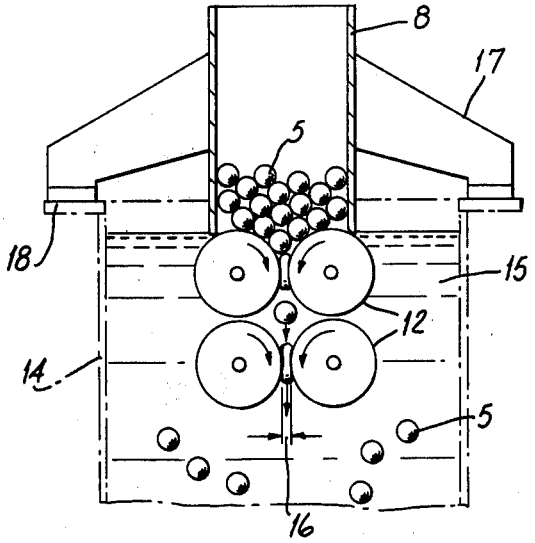
FIG. 7 is a device similar to that of FIG. 6, but having two pairs of rollers.

Cleaning bodies 5*b* of a diameter greater than the gap width first drop—in accordance with FIG. 3—downwardly behind the measuring rails 2 and thus pass into a receiver 8 which can also be the feeding container of the injection device to be described in conjunction with FIGS. 6 and 7.

In the embodiment shown in FIG. 4, only cleaning bodies 5*a* having a diameter equal to or smaller than the smaller gap width will pass through the smaller gap. Cleaning bodies 5*b* with a diameter greater than that but smaller than the diameter of the adjacent gap of greater width will pass, for example, into the receiver 8, while cleaning bodies of still greater diameter, which would lead, for example, to a plugging of the tubes to be cleaned, will pass beyond the measuring rails and can be caught in a third receiver which is not shown.

The embodiment shown in FIG. 5 permits, if the continuously divergent measuring rails are of appropriate length, the separation of cleaning bodies in a manner similar to that represented in FIGS. 3 and 4, but additional sorting into groups of different diameters becomes possible.

One photoelectric cell 11 can be provided for each of the additional groups, especially for group 5*a*, as was provided for group 5*a* of cleaning bodies.

For a faultless sorting operation, the cleaning bodies 5 must be fed individually and successively over the measuring rails. This is accomplished by means of the previously mentioned V-shaped configuration of the sorting trough and by a conveying speed which accelerates towards the end of the sorting trough 2.

Often the worn-out cleaning bodies 5*a* no longer are of spherical shape, but are, for example, cigar-shaped. The V shape of the sorting trough brings it about that the cleaning bodies 5*a* are so aligned with respect to the measuring rails such that they are disposed with their length pointing in the same direction as the gap axis, so that even cleaning bodies which have been worn to a cigar shape are reliably segregated, which is not ensured in the sorting devices of the state of the art as described in the beginning.

Since the sorting device 2 can accommodate only a limited amount of cleaning bodies 5 without the occurrence of clogging or failure of single feed of the cleaning bodies, the feeding container 1 precedes it. The bottom 3 of the feeding container 1 consists for this purpose of one or, as in the illustrated embodiment, several flaps 3*a* which are pivoted at the bottom container margin such that they can swing about an axis which is preferably parallel to the axis of the conveyor trough 2. The flaps 3*a* are rotatable downwardly from the horizontal into the interior of the conveyor trough 2 by means of drivers 6, causing the trough 2 below the feeding container 1 to fill with cleaning bodies. When the flaps 3*a* are then raised again, the cleaning bodies located in the trough 2 are freed of the static pressure of the collumn of cleaning bodies contained in the feeding container 1 and they can therefore be advanced by the vibration of the trough 2 without jamming up. When the trough has been substantially emptied, which can be determined, for example, by means of measuring devices not shown, such as photoelectric cells or the like, the flaps 3*a* are reopened. Alternatively, the flaps 3*a* can also be opened at regular intervals of time, in which case the overfilling of the trough 2 need not be feared, since only as many cleaning bodies will flow into the trough 2 as have previously been carried away by the vibrating operation.

Since cleaning bodies can be caught between the flaps 3*a* and the bottom edges of the container 1, the driver, which can be formed, for example, by an eccentric operated by a motor, can be provided with a connecting means 6 disposed between this driver and the flap, and permits a length accommodation to a certain extent by the fact that this connecting means is elastic. Coil springs 6 are represented for this purpose in FIG. 2. Alternatively, the flap itself or its edges can be pliable, e.g., can consist of hard rubber.

This will prevent damage to the cleaning bodies by the powerful pinching of cleaning bodies between flat 3*a* and the bottom edge of the container 1.

In FIG. 6, the device for injecting cleaning bodies into the coolant circuit is represented schematically in section. The injecting device consists of a container 8 receiving the cleaning bodies 5, which can be identical to the container 8 represented in connection with FIG. 1, but can also be connected with the latter by a conveyor means which is not represented. Under this container 8 there are two rollers 12 which rotate in opposite directions as represented by the arrows. The roller pair 12 extends all the way down into the coolant fluid 15 situated in a lock 14. The gap width 16 between the rollers 12 is adjusted for the diameter of the cleaning bodies 5 and their porosity. The cleaning bodies 5 are drawn into the gap 16 by the rotatory movement of the rollers 12 and are squeezed to such an extent that substantially all of the enclosed air escapes. After the cleaning body 5 emerges from the gap 16 the cleaning bodies expand again and assume their original shape, while the cavities in the cleaning body fill up with the fluid 15. This brings it about that the cleaning bodies assume approximately the same specific gravity as that of the fluid, so that the cleaning bodies will float in this fluid or at least sink or rise slowly according to the specific gravity of the material of the cleaning bodies 5 themselves. In the case of a very great content of closed cells or low porosity of the cleaning bodies 5, it can be desirable to add a second pair 12 of rolls to the first pair, as shown in FIG. 7.

Figure 8:
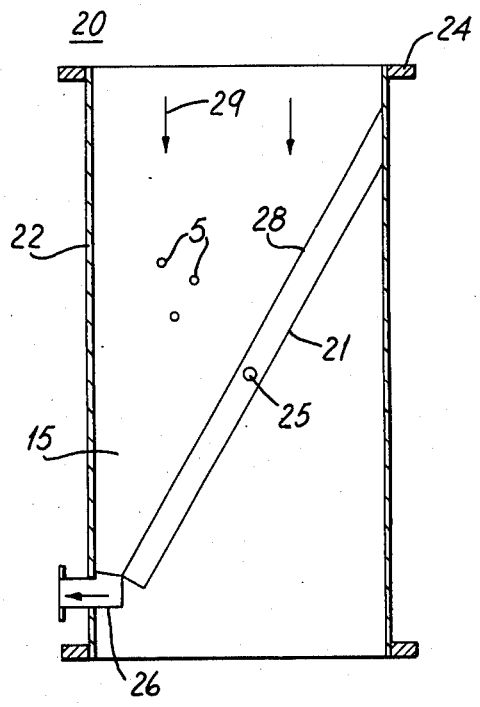
FIG. 8 is a schematic sectional view of a diverter for cleaning bodies.

As seen in FIGS. 6 and 7, the container 8, together with the rollers 12 mounted thereon and driven by drive means not represented, is supported by legs 17 on the flange 18 of the lock edge of the lock 14. The arrangement can, of course, also be such that the cover of the lock is replaced by this injecting device, which bears the reference number 50, i.e., the device 50 can be constructed such that it also effects a sealing of the lock. Further details are not, however, given in the drawing. It can also be desirable—especially when the diameter of tubes 33 and 34 is large on account of a high throughput of fluid—to dispose the injecting device 50 in a by-pass line which carries only a portion of the fluid flowing from device 20 to device 40. In FIG. 8, a diverter 20 is represented schematically in cross section, by which the cleaning bodies can be taken out of the circuit. The diverter represented, which can also have an entirely different form, is a section of pipe which can be inserted by means of flange connections 24 into a pipeline 31 which contains, for example, cooling liquid emerging from the heat exchanger 30 and carrying cleaning bodies 5. The cooling liquid 15 flowing in the direction of the arrows 29 through the pipe section 22 of the diverter 20 comes against a sieve surface 28 whose sieve openings are so selected that the cleaning bodies 5 cannot pass through it, even in the worn condition. The cleaning bodies instead collect at the lower end of the sieve surface 28, to be brought from there through a connection 26 and a pipe not represented into the sorting device 10 represented in FIG. 1.

Figure 9:
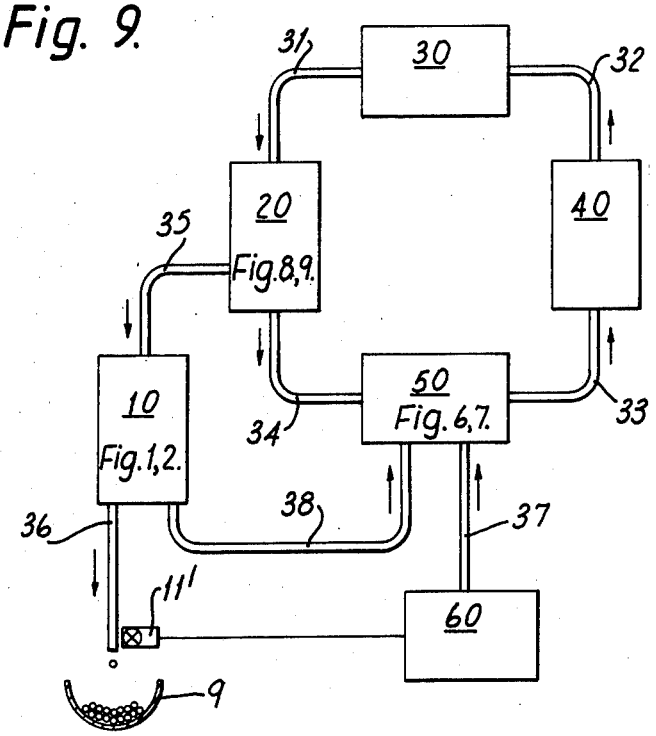
FIG. 9 is a diagrammatic representation of a coolant circuit containing the apparatus of the invention for the segregation of worn-out cleaning bodies.

FIG. 9 once again represents schematically in block diagram form the overall arrangement of the cleaning body removing apparatus in accordance with the invention, in conjunction with a coolant circuit comprising, for example, a heat exchanger 30, a heat generating system 40, the cleaning body injecting device 50, the cleaning body diverter 20, and pipelines 31 to 34 connecting the latter together. Furthermore, the sorting device 10 is represented in the diagram as a block which through a pipe 35 receives cleaning bodies diverted by the diverter 20 for the purpose of sorting. Cleaning bodies rejected as excessively worn are fed through a reject pipe 36 to the waste container 9. Each rejected cleaning body can be detected by a sensing means 11', for example a photoelectric cell, which sensing means feeds, for example, the corresponding information to a supply container 60 which by control means not further represented introduces, for example, through a pipe 37 into the injection device 50, i.e., for example into the container 8 of FIG. 6, one new cleaning body for each rejected cleaning body.

Cleaning bodies which are considered by the sorting device 10 to be still adequate are delivered through pipe 38 also back to the injecting device 50, that is, also for example to the container 8 of FIG. 5.

I claim:

1. In an apparatus for the segragation of worn-out cleaning bodies formed of resiliently deformable material such as rubber or plastic and carried in the coolant fluid circuit of a heat exchanger, the improvement comprising, a diverter inserted into the circuit for the diversion of all the cleaning bodies to a device for sorting cleaning bodies by predetermined diameter limits, said sorting device being disposed outside the coolant fluid circuit and including;

a branch pipe connecting said diverter with a feeding container to deliver the cleaning bodies to said feeding container;

a cleaning body separator disposed beneath said feeding container for receiving cleaning bodies there-from and operable to separate reusable cleaning bodies having a greater than a predetermined cross-section dimension from those worn-out bodies having a smaller than predetermined cross-section dimension, said separator comprising a downwardly tapered trough having a vibrator to cause cleaning bodies to move therethrough, and a restricted opening portion formed of two spaced apart rails operable to separate the reuseable from the worn-out cleaning bodies by cross-section dimension, and means to return the reuseable cleaning bodies to the coolant fluid circuit.

2. Apparatus of claim 1 wherein said rails are parallel to each other.

3. Apparatus of claim 1 wherein said rails are divergent with respect to each other.

4. The apparatus of claim 1, wherein said feeding container comprises a bottom having at least one flap hinged to the lower edge of the container and a drive means, said flap being adapted to be swung by said drive means downwardly from the horizontal into the trough.

5. The apparatus according to claim 4, wherein said drive means comprises a motor-operated eccentric and a resilient connecting element, said connecting element connecting said drive means and said flap to permit longitudinal adjustment therebetween.

6. The apparatus of claim 5 wherein said connecting means comprises a spring.

7. The apparatus of claim 1, further comprising a counting means connected with said sorting device to count the cleaning bodies sorted by said sorting device.

8. The apparatus of claim 7, wherein said counting means comprises an electric eye and a counting mechanism said electric eye generating pulses to be tallied by said counting mechanism.

9. The apparatus of claim 1, further comprising an injecting device to introduce additional cleaning bodies into the circuit, said injecting device being connected to an outlet of the sorting device and thereafter into said means for returning cleaning bodies into the circuit, said injecting device comprising means for squeezing cleaning bodies thereby to expel air which may be trapped in the cleaning bodies, said squeezing means having a container receiving the cleaning bodies and a squeezing device of one or more pairs of rolls disposed beneath said container.

10. The apparatus of claim 9 wherein the rolls of each said pair of rolls are driven to rotate in opposite directions.

11. The apparatus of claim 9 wherein said injecting device further comprises a supply container for cleaning bodies operable to respond to the counting means for segregated cleaning bodies to feed cleaning bodies to the injecting device.

12. The apparatus of claim 9 wherein said diverter and said injecting device are constructed as pressure-tight locks permitting continuous operation.

* * * * *